United States Patent [19]

Hartley et al.

[11] Patent Number: 4,827,832

[45] Date of Patent: May 9, 1989

[54] VALVE SYSTEM FOR A RECIPROCATING DEVICE

[75] Inventors: E. Dale Hartley, Malibu; F. Scott Hartley, Camarillo, both of Calif.

[73] Assignee: Product Research and Development, Santa Ana, Calif.

[21] Appl. No.: 443,589

[22] Filed: Nov. 22, 1982

[51] Int. Cl.[4] ..... F01L 31/02

[52] U.S. Cl. ..... 91/269; 91/273; 91/342; 91/346; 137/868; 251/75

[58] Field of Search ..... 91/341 R, 344, 346, 91/323, 342, 341 A, 343, 347, 273, 272, 271, 269; 251/75; 137/868

[56] References Cited

U.S. PATENT DOCUMENTS

| | | | |
|---|---|---|---|
| 294,807 | 3/1884 | Reese | 91/346 |
| 880,298 | 2/1908 | Grant et al. | 91/344 |
| 2,601,848 | 7/1952 | Dahlberg | 91/342 |
| 2,778,345 | 1/1957 | Dolza et al. | 91/344 |
| 2,869,515 | 1/1959 | Platzer | 91/347 |
| 3,021,823 | 2/1962 | Dinkelkamp | 91/346 |
| 3,218,935 | 11/1965 | York et al. | 91/346 |
| 3,489,254 | 1/1970 | Sparrow | 251/75 |
| 4,118,005 | 10/1978 | O'Neil et al. | 251/75 |
| 4,172,698 | 10/1979 | Hinz et al. | 91/346 |
| 4,325,285 | 4/1982 | Roser . | |

FOREIGN PATENT DOCUMENTS

| | | | |
|---|---|---|---|
| 2476760 | 8/1981 | France . | |
| 80/02722 | 12/1980 | PCT Int'l Appl. . | |
| 0611036 | 6/1978 | U.S.S.R. | 91/346 |
| 2060086 | 4/1981 | United Kingdom . | |

*Primary Examiner*—Edward K. Look
*Attorney, Agent, or Firm*—Gordon L. Peterson

[57] ABSTRACT

A reciprocable device comprising a reciprocable member mounted for reciprocating movement within a chamber and a valve system for controlling the supply of fluid under pressure to the reciprocable member to bring about reciprocation of such member. A motor is enabled by the reciprocable member to operate the valve system whereby at least some of the force for driving the valve system is obtained from the motor and not from the reciprocable member.

14 Claims, 2 Drawing Sheets

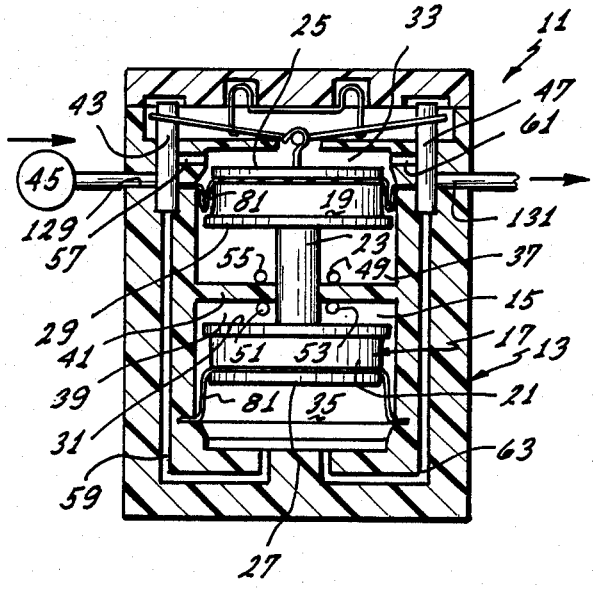
Fig. 1
Fig. 2a
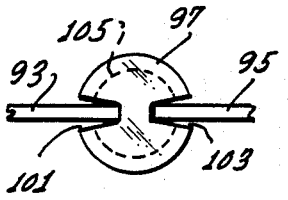
Fig. 2
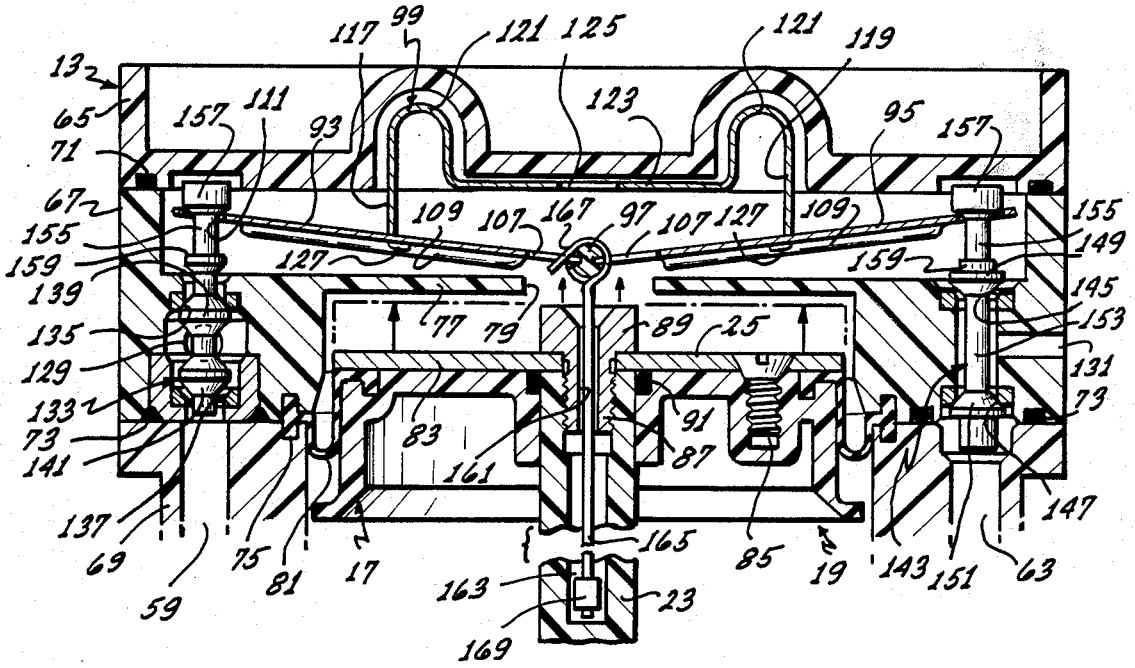
Fig. 3
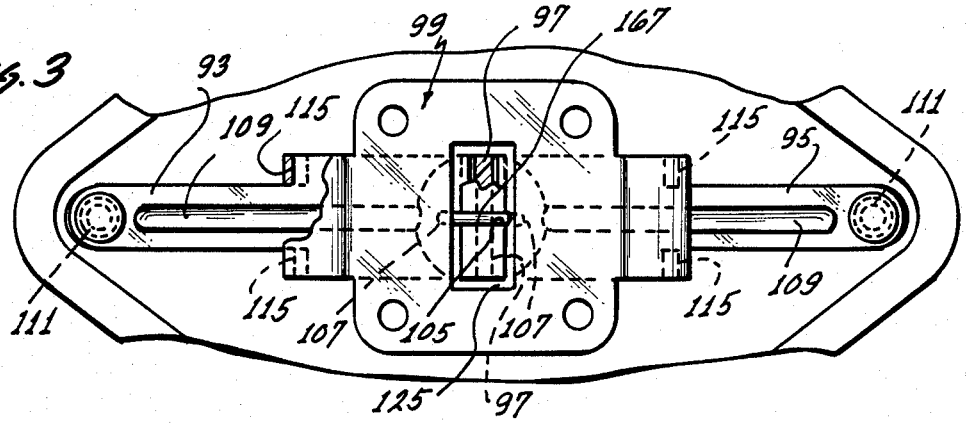

VALVE SYSTEM FOR A RECIPROCATING DEVICE

BACKGROUND OF THE INVENTION

Reciprocable devices typically include a reciprocable member which reciprocates to perform a useful function, such as pumping a flowable material, compressing a gas, metering a fluid or providing a reciprocating output for other purposes. A driving fluid under pressure is commonly used to reciprocate the reciprocable member. For example, the reciprocable member may be a piston having first and second faces which are alternately exposable to driving fluid under pressure and to exhaust. A valve system is provided for controlling the exposure of the piston faces to the pressurized driving fluid and to exhaust. In order for the valve system to perform its function, the valve system typically includes one or more valve elements which must be moved periodically from one position to another to bring about reciprocation of the piston. One problem has been to provide a simple, reliable and inexpensive mechanism for repeatedly operating the valve system.

One way to operate the valve system is to drive the valve elements with energy from the piston as the piston nears the end of its stroke. Although this approach is theoretically sound, in practice, the piston will stall if the valve system is not completely operated before the piston stops. In this event, the switching of the valve system cannot occur, and the reciprocable device stalls.

SUMMARY OF THE INVENTION

This invention overcomes the tendency of reciprocating devices to stall as a result of incomplete switching of the valve system or valve means before the piston reaches the end of its stroke. To accomplish this, this invention provides motor means which is enabled by the piston for switching the valve system. With this arrangement, at least some of the force for driving the valve system is obtained from the motor and not from the piston. Accordingly, even if the piston should stop, the valve switching operation can be completed by the motor, and stalling of the piston is prevented.

The motor means can be simply, economically and reliably embodied in spring means which is energized by the piston to provide at least some of the force for driving or switching the valve system. More particularly, the spring means can advantageously be bistable and have first and second states and a neutral position between such states. The piston motion can be used to drive the bistable spring means from one of its states through the neutral position. The resilience of the bistable spring means then at least assists in moving the spring means from the neutral position toward the other of its states. The motion of the spring means from and/or beyond the neutral position toward such other state thereof is used to accomplish valve switching and thus, it is the resilience of the spring means or the energy stored in the spring that is used to accomplish switching. Piston motion is used only to drive the bistable spring means through the neutral position.

The bistable spring means is drivingly coupled to the valve system. This coupling is accomplished with some lost motion so that the bistable spring means does not initiate movement of the valve system until the bistable spring means has moved a first distance beyond the neutral position toward its other state. Because the bistable spring means can apply a greater force in a position displaced from the neutral position, this feature has the advantage of assuring that the bistable spring means will reach a position where it can apply sufficient force to the valve system to appropriately move it.

The valve system preferably includes a supply valve for controlling the supply of driving fluid under pressure to the piston and an exhaust valve for controlling the exhausting of fluid pressure from the piston. Each of these valves preferably includes first and second spaced valve seats and a valve element movable between such seats. With this invention, the driving fluid under pressure tends to retain the valve elements in engagement with whatever seat such valve elements are in engagement with. This assures that fluid under pressure will tend to drive the piston until the bistable spring means has been moved through the neutral position and to a position where it can unseat the supply and exhaust valves.

In a preferred construction, the bistable spring means includes first and second levers, means for mounting the levers for pivotable movement about a pivot axis and resilient means for urging the levers toward the pivot axis. The first and second levers are drivingly coupled to the valve elements of the supply and exhaust valves, respectively. Although a leaf spring could be used in lieu of the levers and hinge pin, longitudinally rigid levers are preferred because they more efficiently transmit the force to the valve elements The resilient means can take various different forms, such as a spring bracket or a coil compression spring acting through an intermediate force applying member to one of the levers.

Although the reciprocable member of the reciprocating device is referred to herein as a "piston", in a broader sense, the reciprocable member can be any member which reciprocates. For example, the reciprocable member may be, or include, a diaphragm, bellows, etc.

The invention, together with additional features and advantages thereof, may best be understood by reference to the following description taken in connection with the accompanying illustrative drawing.

BRIEF DESCRIPTION OF THE DRAWING

FIG. 1 is a schematic view of a reciprocable device constructed in accordance with the teachings of this invention.

FIG. 2 is a fragmentary longitudinal sectional view through one end portion of the reciprocable device with the piston moving up.

FIG. 2*a* is an enlarged fragmentary front view of the hinge pin and the two levers.

FIG. 3 is a fragmentary top plan view of the reciprocable device with the top housing section removed and with portions being broken away and in section.

DESCRIPTION OF THE PREFERRED EMBODIMENT

Figure 4:
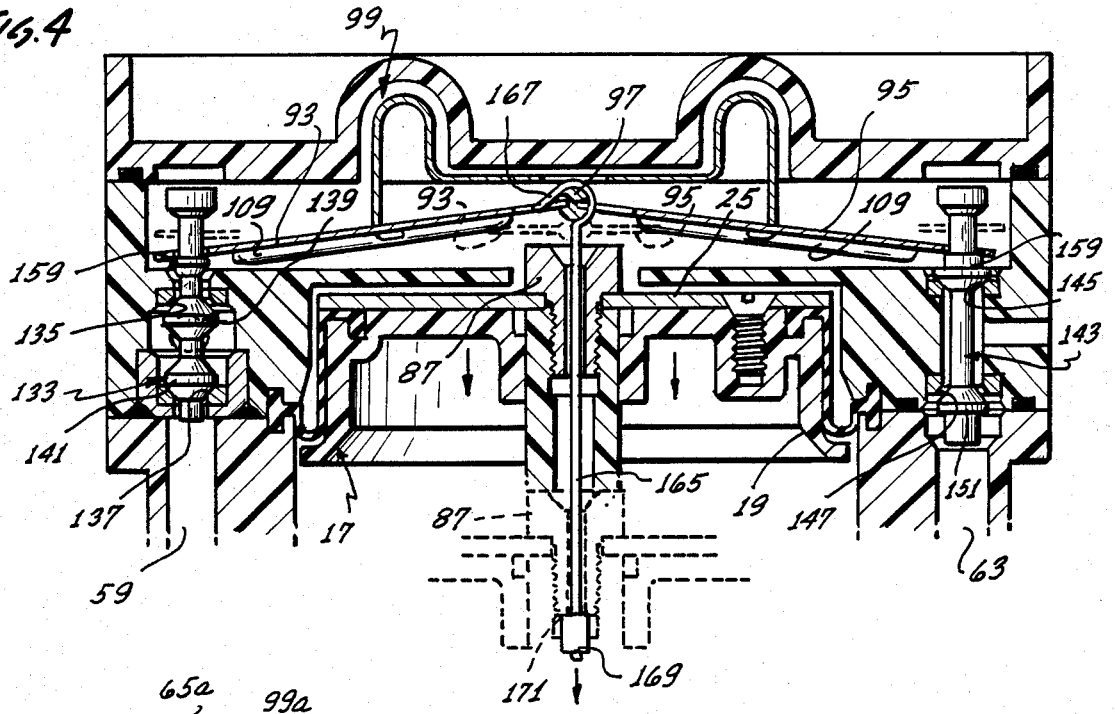
FIG. 4 is a sectional view similar to FIG. 2 illustrating the operation of the supply and exhaust valves and with the piston moving downwardly.

FIG. 1 shows a reciprocable device 11 which includes wall means in the form of a housing 13 defining a chamber or cylinder 15 in which a piston 17 is slidably mounted for reciprocating movement. In the form shown in FIG. 1, the reciprocable device 11 is a pump; however, the reciprocable device may be a compressor, meter or serve some other purpose. Although the piston 17 can be of different constructions, in the form illustrated, it includes piston sections 19 and 21 joined together by a rod 23 and having driving faces 25 and 27 and pumping faces 29 and 31. With this arrangement, the chamber 15 is divided into driving chambers 33 and 35 at the opposite ends of the piston 17 and pumping chambers 37 and 39 between the piston sections 19 and 21 and a partition 41.

A supply valve 43 controls the supply of fluid under pressure from a source 45 to the driving chambers 33 and 35, and an exhaust valve 47 controls the exhausting of the driving chambers 33 and 35 to atmosphere or other place of reduced pressure. By operating the valves 43 and 47, the piston 17 is reciprocated in the chamber 15.

As the piston 17 moves downwardly (as viewed in FIG. 1), liquid in the pumping chamber 37 is forced through an outlet 49 and an outlet check valve (not shown) to a location where it is to be utilized and liquid is drawn in through an inlet check valve (not shown) and an inlet 51 into the pumping chamber 39. When the piston 17 reverses, the liquid in the pumping chamber 39 is forced through an outlet 53 and an outlet check valve (not shown), and liquid is drawn in to the pumping chamber 37 through an inlet check valve (not shown) and an inlet 55.

Except for the particular construction of the valves 43 and 47 and the manner in which they are operated, the construction shown in FIG. 1 may be conventional. FIG. 1 does, however, illustrate, by way of example, one form of reciprocable device in which the concepts of this invention may be embodied.

More specifically and with further reference to FIG. 1, the driving fluid under pressure can be supplied through a supply passage section 57 to the driving chamber 33 or through a supply passage section 59 to the driving chamber 35. Similarly, pressure in the driving chambers 33 and 35 can be exhausted through the exhaust passage sections 61 and 63, respectively.

Turning now to FIG. 2, the housing 13 comprises housing sections 65, 67 and 69 appropriately joined together and sealed by seals 71, 73 and 75. The housing section 69 forms a main body for the housing. The housing section 67 is an intermediate housing section that provides an intermediate wall 77 having a central opening 79 and the housing section 65 forms an end wall for the housing.

The piston sections 17 and 19 are sealed to the wall of the cylinder 15 by diaphragms 81 having the seals 75 integral therewith as shown in FIG. 2 for the diaphragm for the piston section 19. The diaphragm 81 is retained on the piston section 19 by a plate 83 which is attached to the piston section by one or more fasteners 85 and attached to the rod 23 by a screw 87 having a head 89. An annular seal 91 seals the piston section 19 to the rod 23.

In this embodiment, the motor includes bistable spring means which comprises identical levers and 95, a hinge pin 97 and a spring 99 in the form of a spring bracket The hinge pin 97 has recesses 101 and 103 (FIG. 2*a*) extending longitudinally thereof and a centrally located annular groove 105 As shown in FIG. 2*a*, each of the recesses 101 and 103 progressively widens as it extends radially toward the periphery of the hinge pin 97 and this allows each of the levers to pivot about a pivot axis at the inner end of the associated recess.

The lever 93, which may be constructed of stainless steel, has a recess 107 opening at one end thereof, an elongated dished or channel section 109 to make the lever 93 longitudinally rigid, and an opening adjacent its outer end. As shown in FIG. 3, the inner portions of the lever 93 are wider than the outer portions to provide shoulders 115. Portions of the lever 95 corresponding to portions of the lever 93 are designated by corresponding reference numerals The spring 99 has legs 117 and 119 integrally coupled by U-sections 121 and a web 123 having an opening 125. The outer end portions of the legs 117 and are turned inwardly to form tabs 127.

As shown in FIG. 2, the inner end portions of the levers 93 and 95 are received within the recesses and 103, respectively, and the spring 99 has the lower regions of its legs 117 and 119 bearing against the shoulders 115 of the two levers. Accordingly, the levers 93 and 95 are biased toward the hinge pin 97 which forms pivot axes for the levers by virtue of the progressively widening nature of each of the recesses 101 and 103. The in-turned tabs 127 tend to retain the spring 99 on the levers 93 and 95, and the U-sections provide added resilience for the spring.

Considered together, the supply passage sections 57 and 59 form a supply passage and a port 129 through the housing section 67 provides communication between the supply passage and a conduit leading to the source 45 The supply valve 43 is located in the supply passage in communication with the port 129. Similarly, the exhaust valve 47 is located in an exhaust passage formed by the exhaust passage sections 61 and 63 and it communicates with an exhaust port 131.

The supply valve 43 includes a valve element 133 and valve seats 135 and 137. The valve element 133 has heads 139 and 141 joined by a rod, and the heads are engageable with the valve seats 135 and 137, respectively. The arrangement is such that when the head 139 seats against the valve seat 135, the head 141 is spaced from the valve seat 137 as shown in FIG. 2. Conversely, with the head 141 seated on the seat 137, the head 139 is spaced from the seat 135 as shown in FIG. 4. Thus, the supply valve 43 will supply fluid under pressure to either the supply passage section 57 or the supply passage section 59.

Similarly, the exhaust valve 47 includes a valve element 143 and valve seats 145 and 147. The valve element 143 includes heads 149 and 151 appropriately joined by a rod 153. The arrangement is such that, with the head 151 engaging the seat 147, the head 149 is spaced from the seat 145 so that fluid pressure in the exhaust passage section 61 can be exhausted through the exhaust port 131 as shown in FIG. 2. Conversely, the valve element 143 can be moved to the position of FIG. 4 in which the heads 149 and 151 are seated and unseated, respectively, on their associated valve seats.

To drivingly couple the supply valve 43 to the lever 93, the valve element 133 includes a coupling portion 155 receivable in the opening 111 of the lever 93, with the lever 93 being between spaced collars 157 and 159 carried by the coupling portion 155. The collar 157 is removable to permit the coupling portion 155 to be received within the opening 111. The lever 95 is similarly drivingly connected to the valve element 143, and corresponding portions are designated by corresponding reference numerals. It should be noted that both the valve elements 133 and 143 can move between their respective valve seats with essentially no sliding friction.

In the position shown in FIG. 2, fluid under pressure is supplied through the supply passage section 59 to the face 27 (FIG. 1) and the head 139 engages the valve seat 135 to prevent the driving fluid at supply pressure from being supplied to the face 25. Similarly, the face 25 is exposed to exhaust pressure at the port 131, and the engagement of the head 151 with the valve seat 147 isolates the face 27 from the exhaust port 131. The driving fluid at supply pressure acts on the lower regions of the head 139 and on the lower regions of the head 151 to tend to maintain engagement with the valve seats 135 and 147, respectively. In addition, the spring 99 acting through the levers 93 and 95 tends to hold the valve elements 133 and 143 upwardly by virtue of the engagement of the levers with the collars 157.

The screw 87 has a bore 161 which communicates with a bore 163 in the rod 23. An elongated coupling member 165 having a hook 167 at one end and a collar 169 at the other is mounted for free movement in the bores 161 and 163. The hook 167 is received in the groove 105 of the hinge pin 97 and it extends through the recesses 107 of the levers 93 and 95.

With the valve elements 133 and 143 in the position shown in FIG. 2, the piston 17 moves upwardly and, as the piston nears the upper end of its stroke, the upper surface of the head 89 engages the hinge pin 97 and moves it from the position shown in FIG. 2 through the neutral position shown in dashed lines in FIG. 4 in which the levers 93 and 95 and the hinge pin are essentially co-planar. Once the hinge pin 97 is moved through the neutral position, i.e., over center, the resilience of the spring 99 rapidly forces the hinge pin 97 farther over center toward the other of its states. This moves the end portions of the levers 93 and 95 downwardly into engagement with the collars 159, respectively, to push both of the valve elements 133 and 143 simultaneously downwardly and into engagement with their seats 137 and 145 as shown in FIG. 4. This supplies driving fluid under pressure to the face 25 and vents or exhausts fluid from the face 27 so that the piston 17 moves in the other direction.

It should be noted that the piston 17 needs to travel only far enough to get the hinge pin 97 through the neutral or center position, and thereafter the resilience of the spring 99 forces the levers 93 and 95 and the hinge pin 97 over center. In addition, it is the force of the spring 99 which unseats and moves the valve elements 133 and 143 and not the force of the piston 17. By providing a space between the collars 157 and 159 on each of the associated valve elements, some free travel or lost motion between the levers 93 and 95 and the associated valve element is provided. This assures that the levers 93 and 95 will be far enough over center when they move into engagement with the collars 159 to exert a substantial force on the valve elements 133 and 143 which is sufficient to unseat them. Of course, the farther the hinge pin 97 moves over center, the greater is the force applied by the levers 93 and 95.

As the piston 17 travels in the other direction, i.e., downwardly, as viewed in FIG. 4, the coupling member 165 remains stationary by virtue of the engagement between the hook 167 and the hinge pin 97. However, when the piston 17 nears the other end of its stroke, the collar 169 engages a lower surface 171 of the screw 87 as shown in dashed lines in FIG. 4 so that thereafter the coupling member 165 is driven downwardly by the piston. This causes the coupling member 165 to pull the hinge pin 97 through the neutral position. Although the piston 17 could move with the hinge pin 97 beyond the neutral position all the way to the other state of the levers 93 and 95, typically, the resilience of the spring will move the hinge pin ahead of the hook 167. However, even if the piston 17 should stop before the other state is reached, the resilience of the spring 99 would provide the necessary driving force for moving the valve elements 133 and 143 back to the position of FIG. 2.

Figure 5:
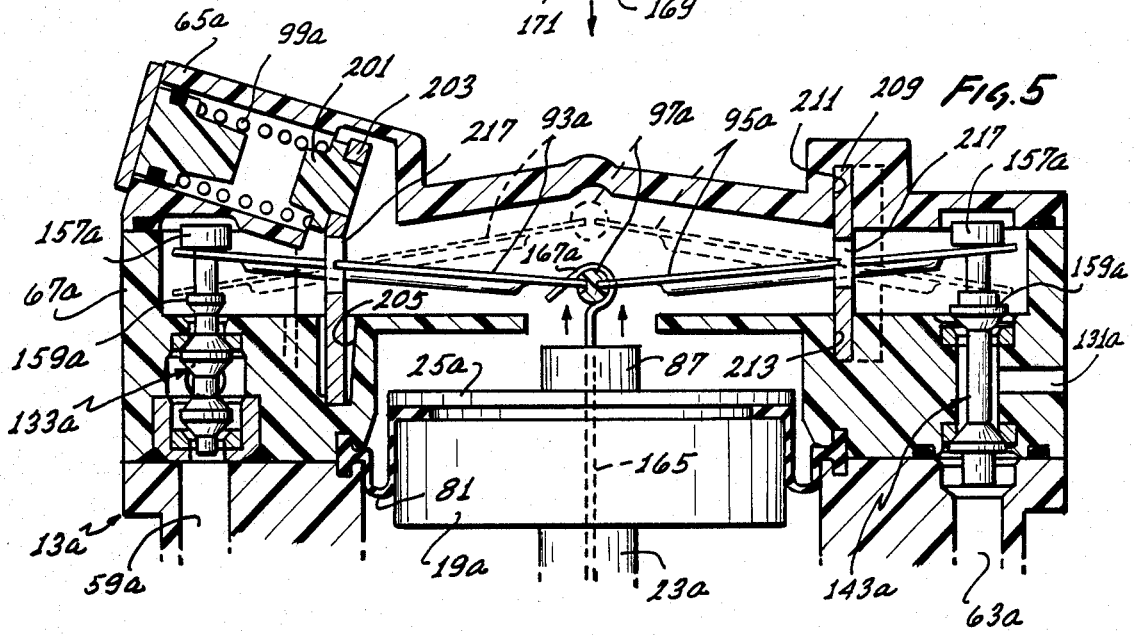
FIG. 5 is a fragmentary sectional view similar to FIG. 2 illustrating a second embodiment of the invention with the second state of the levers being shown in dashed lines.
Figure 6:
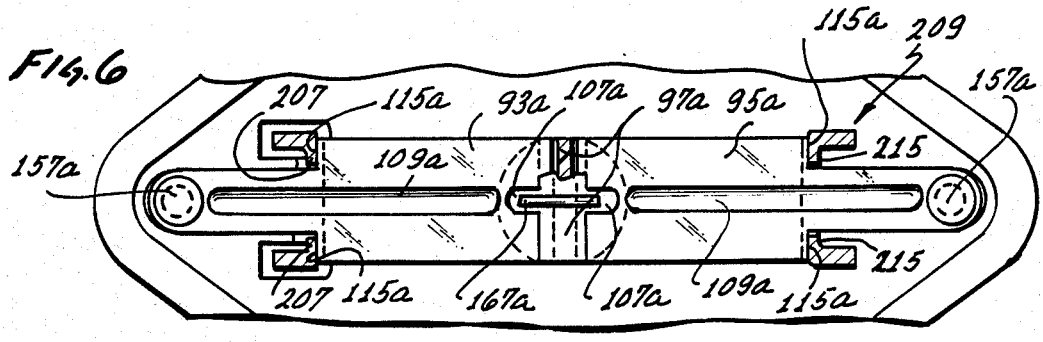
FIG. 6 is a fragmentary plan view partially in section of the construction shown in FIG. 5 with the top housing section removed and with portions being broken away and in section.

FIGS. 5 and 6 show a second embodiment of the invention which is adapted for use with higher fluid pressures where a greater spring force is required. This embodiment is identical to the embodiment described above in all respects not shown or described herein. Portions of the embodiment of FIGS. 5 and 6 corresponding to portions of the embodiment of FIGS. 1–4 are designated by corresponding reference numerals followed by the letter "a."

The primary difference between these embodiments is that, in FIGS. 5 and 6, the bracket-like spring has been eliminated in favor of a coil compression spring **99*a* which is mounted within the housing section 65*a* and which biases a plunger 201 radially inwardly. An intermediate force applying member 203 is pivotally received in a socket 205 of the intermediate housing section 67*a* and has shoulders 207 (FIG. 6) for bearing against the shoulders 115*a* of the lever 93*a*. Thus, the resilient force of the spring 99*a* is applied through the plunger 201, the intermediate member 203, the lever 93*a* and the hinge pin 97*a* to the lever 95*a*. A stop member 209 which is retained in pockets 211 and 213 of the housing 13*a* has shoulders 215 which engage the shoulders 115*a* of the lever 95*a* to thereby prevent movement of the lever 95*a* to the right of the position shown in FIGS. 5 and 6. The members 203 and 209 have openings 217 to allow passage of the levers 93*a* and 95*a*, respectively, therethrough. The operation of the embodiment of FIGS. 5 and 6 is the same as that described above for the embodiment of FIGS. 1–4**.

Although exemplary embodiments have been shown and described, many changes, modifications and substitutions may be made by one having ordinary skill in the art without necessarily departing from the spirit and scope of this invention.

What is claimed:

1. A reciprocable device comprising:

wall means defining a chamber;

a reciprocable member in the chamber and having first and second faces exposable to a driving fluid under pressure to reciprocate the reciprocable member in the chamber;

valve means including first and second movable valve elements for controlling the supply and exhaust of the driving fluid under pressure to and from the first and second faces whereby the reciprocable member can be reciprocated in said chamber;

bistable spring means having first and second states and a neutral position between said states thereof for at least assisting in driving the valve elements, said bistable spring means including first and second levers, a hinge pin between said levers and having first and second recesses for receiving inner end portions of the first and second levers, respectively, and spring means for urging the first and second levers into the first and second recesses, respectively, of the hinge pin;

means for drivingly coupling the reciprocable member and the bistable spring means so that said reciprocable member can move the bistable spring means from one of its states through the neutral position with the resilience of the bistable spring means at least assisting in moving the bistable spring means from the neutral position toward the other state thereof;

first means for drivingly coupling the first and second levers and the first and second valve elements, respectively, whereby movement of the bistable spring means to said other state drives the first and second valve elements; and said spring means including first and second legs drivingly coupled to the first and second levers, respectively, and a web for joining the first and second legs.

2. A reciprocable device as defined in claim 1 wherein said valve means includes first and second spaced valve seats and the first valve element is movable to engage the first and second valve seats and the driving fluid under pressure tends to retain the valve element in engagement with whichever of said first and second valve seats the valve element is engaging.

3. A reciprocable device as defined in claim 1 wherein said first means drivingly couples the bistable spring means and the first and second valve elements with some lost motion so that the bistable spring means does not come into driving engagement with the valve elements to move the valve elements until the bistable spring means has moved a first distance beyond the neutral position toward said other state.

4. A reciprocable device as defined in claim 1 wherein said coupling means for the reciprocable member and bistable spring means includes a surface driven by the reciprocable member for driving the bistable spring means through the neutral position in one direction and a coupling member driven by the reciprocable member for driving the bistable spring means through the neutral position in the other direction, said bistable spring means being driven through the neutral position as the reciprocable member approaches each end of its stroke in its reciprocating movement.

5. A reciprocable device as defined in claim I wherein the hinge pin is movable and said means for drivingly coupling the reciprocable member and the bistable spring means includes means for engaging the hinge pin to drive the bistable spring means from one of its states through the neutral position.

6. A reciprocable device as defined in claim 1 wherein the hinge pin being movable and said means for drivingly coupling the reciprocable member and the bistable spring means includes means for engaging the hinge pin to drive the bistable spring means from one of its states through the neutral position.

7. A reciprocable device as defined in claim 1 wherein said bistable spring means is at one end of the chamber and forms the only means to initiate movement of said valve means between the first and second positions thereof.

8. A reciprocable device as defined in claim 1 wherein at least one of said valve means includes first and second spaced valve seats and a valve element movable between said valve seats, said valve element being movable between said seats with essentially no sliding friction.

9. A reciprocable device as defined in claim 8 wherein said bistable spring means is at one end of the chamber and forms the only means to initiate movement of said valve means between the first and second positions thereof, the hinge pin is movable and said means for drivingly coupling the reciprocable member and the bistable spring means includes means for engaging the hinge pin to drive the bistable spring means from one of its states through the neutral position.

10. A reciprocable device comprising:

wall means defining a chamber;

a reciprocable member in the chamber, said reciprocable member at least assisting in dividing the chamber to provide first and second working chambers and having first and second faces exposable to a driving fluid under pressure in said first and second working chambers, respectively, to reciprocate the reciprocable member in the chamber;

valve means having a first position in which the valve means exposes said first working chamber and the first face to the driving fluid under pressure and the second working chamber and the second face to a reduced pressure and a second position in which the valve means exposes the second working chamber and the second face to the driving fluid under pressure and the first working chamber and the first face to a reduced pressure whereby the reciprocable member can be reciprocated in said chamber;

bistable spring means communicating with said first working chamber in said first and second positions of said valve means and having first and second states thereof for at least assisting in driving the valve means between the first and second positions thereof, said bistable spring means including first and second longitudinally rigid levers, movable means for mounting each of the levers for pivotal movement about a pivot axis and a resilient spring bracket coupled to the first and second levers outwardly of the movable means;

means extending between the reciprocable member and the movable means of the bistable spring means for drivingly coupling the reciprocable member and the bistable spring means so that said reciprocable member can move the bistable spring means from one of its states through the neutral position with the resilience of the bistable spring means at least assisting in moving the spring means from the neutral position toward the other state thereof; and means for drivingly coupling the bistable spring means and the valve means whereby movement of the bistable spring means to said other state drives the valve means from said first position to said second position.

11. A reciprocable device as defined in claim 10 wherein said movable means includes a hinge pin having first and second recesses for pivotally receiving portions of the first and second levers, respectively and said spring bracket resiliently urges said portions of the first and second levers into said first and second recesses, respectively.

12. A reciprocable device as defined in claim 11 wherein said spring bracket includes first and second legs drivingly coupled to the first and second levers, respectively, and a web for joining the first and second legs.

13. A reciprocable device as defined in claim 10 wherein said spring bracket extends from the locations where the spring bracket is coupled to said first lever inwardly, across the movable means, and outwardly to the location where the spring bracket is coupled to the second lever.

14. A reciprocable device as defined in claim 10 wherein the driving fluid under pressure tends to retain the valve means in whichever of said positions it is in.

* * * * *

UNITED STATES PATENT AND TRADEMARK OFFICE

CERTIFICATE OF CORRECTION

PATENT NO. : 4,827,832

DATED : May 9, 1989

INVENTOR(S) : E. Dale Hartley et al

It is certified that error appears in the above-identified patent and that said Letters Patent is hereby corrected as shown below:

Column 3, line 68 after "levers" insert -- 93 --.

Column 4, line 2 after "bracket" insert -- . --

Column 4, line 4 after "105" insert -- . --

Column 4, line 12 after "opening" insert -- 111 --.

Column 4, line 20 after "117 and" insert -- 119 --.

Column 4, line 23 after "recesses" insert -- 101 --.

Column 4, line 31 after "U-sections" insert -- 121 --.

Column 4, line 37 after "45" insert -- . --.

Signed and Sealed this

Twenty-fourth Day of April, 1990

*Attest:*

HARRY F. MANBECK, JR.

*Attesting Officer*

*Commissioner of Patents and Trademarks*